United States Patent [19]

Tsuda

[11] Patent Number: 4,589,947

[45] Date of Patent: May 20, 1986

[54] STRAW ADHERING APPARATUS FOR BEVERAGE VESSELS

[75] Inventor: Masaaki Tsuda, Tokyo, Japan

[73] Assignee: Kabushiki Kaisha Takara, Osaka, Japan

[21] Appl. No.: 591,522

[22] Filed: Mar. 20, 1984

[51] Int. Cl.[4] ..... B65B 19/34; B32B 31/00

[52] U.S. Cl. ..... 156/521; 53/127; 53/128; 156/566

[58] Field of Search ..... 53/128, 137, 383, 410, 53/513, 520, 522; 156/521, 522, 566, 567; 493/87, 131, 475, 478

[56] References Cited

U.S. PATENT DOCUMENTS

| | | | |
|---|---|---|---|
| 2,981,432 | 4/1961 | Flood | 53/137 X |
| 3,115,232 | 12/1963 | Carter | 156/566 X |
| 3,178,329 | 4/1965 | Rohbogner | 156/522 X |
| 3,555,771 | 1/1971 | Mathes | 53/137 X |
| 3,562,072 | 2/1971 | Stellamanns et al. | 156/566 |
| 4,172,753 | 10/1979 | Benoit | 156/566 X |
| 4,293,369 | 10/1981 | Dilot et al. | 156/566 X |
| 4,354,894 | 10/1982 | Lewis et al. | 156/521 X |
| 4,384,915 | 5/1983 | Utsumi | 156/499 |

FOREIGN PATENT DOCUMENTS 58-53007 4/1983 Japan .

*Primary Examiner*—Robert L. Spruill
*Assistant Examiner*—Michael D. Folkerts
*Attorney, Agent, or Firm*—Wenderoth, Lind & Ponack

[57] ABSTRACT

The present invention relates to an apparatus for adhering straws, each being packed in a plastic film, to external surfaces of beverage vessels for milk, juice, etc. which are sold by vendor machines. Specifically, a straw adhering apparatus for beverage vessels wherein a continuous laminated plastic film strip which incorporates straws separately and individually and is provided with an array of punched feed holes at upper and lower end parts of the strip is cut into individual straw packs by a cutter on the way of the strip feed passage. Upper and lower edges of each straw pack are delivered respectively by a pair of seizing feed belts to the main carrying conveyor path for a beverage vessel to which the straw pack is adhered to an external surface of the beverage vessel onto which an adhesive agent is applied in advance. An adhesion retaining belt which maintains a state of adhesion of the straw pack to the beverage vessel is provided at a side of the main carrying conveyor. A vessel top holding belt which prevents rocking of beverage vessels is provided at the upper position and straw packs are positively adhered consecutively to beverage vessels which are intermittently delivered by the separating turret provided in the path of the main conveyor.

3 Claims, 8 Drawing Figures

STRAW ADHERING APPARATUS FOR BEVERAGE VESSELS

BACKGROUND OF THE INVENTION (1) Field of the Invention

The present invention relates to an apparatus for adhering straws which are individually packed with a plastic film to external surfaces of beverage vessels for milk, juice, etc. that is, so-called pack containers which are sold by vendor machines, specifically, a straw adhering apparatus for beverage vessels which adheres mechanically and consecutively a straw pack containing a straw onto external surfaces of beverage vessels which are intermittently delivered on the carrying conveyor.

(2) Description of the Prior Art

Recently, milk, juice and other kinds of beverage packed in paper vessels which are called "pack containers" have been generally sold by vendor machines. In this case, these paper beverage vessels are sold with a straw for sucking the beverage which is combined with a beverage vessel. Moreover straws are individually packed one by one with a plastic film for a hygienic reason and adhered to the side of each beverage vessel by a heat sealing method.

A straw adhering apparatus has been proposed to mechanically and continuously adhere each straw pack to each beverage vessel. In other words, separate straw packs are prepared in advance and fed one by one and adhered to beverage vessels individually by heat sealing or hot melt application. For example, in case of the straw adhering apparatus for pack containers which was published in Japanese Patent No. 58-53007 on Apr. 11, 1983, the adhering apparatus which cuts continuous plastic film straw packs, each pack containing a straight straw, into individual straw packs and adheres a straw pack slantly onto the external surface of a beverage vessel, has been proposed. In this case, a configuration is shown which is intended to slant the beverage vessel obliquely on the carrier device in order to adhere the straw pack slantly onto the external surface of the beverage vessel, apply a straw to the beverage vessel to the external surface of a slanted beverage vessel by an endless straw feeding device which moves circulatively while vacuum-absorbing straw packs one by one and adhere the straw pack to the beverage vessel with a hot melt type adhesive agent which is applied in advance to the external surface of the beverage vessel.

In the case of the above apparatus, however, various problems have been pointed out. For example, the constructional complexity of the apparatus because of carrying slanted beverage vessels, difficulty in determination of the timing between the adhering position and cancellation of vacuum absorption of individual straw packs to be adhered to the beverage vessels, defect prone to cause a faulty operation, and large construction of the whole apparatus because of employment of the vacuum absorbing device have been pointed out.

SUMMARY OF THE INVENTION

The present invention, in view of the above-mentioned actualities, is to cut a continuous straw-contained strip provided with an array of punched feed holes at its upper and lower end parts into individual straw packs by the cutter provided on the way of the strip feed passage, deliver the upper and lower end parts of each of these individual straw packs into the main carrying conveyor path for a beverage vessel to which the straw pack is to be adhered by a pair of seizing feed belts to cause the upper and lower end parts of the straw pack to the external lateral surface of the beverage vessel to which the adhesive agent is applied in advance, and positively adhere the straw packs consecutively to the beverage vessels which are intermittently delivered by the separating turret, provided on the way of the main carrying conveyor path while maintaining a state of adhesion by the adhesion retaining belt provided at the side of the main carrying conveyor, and preventing rocking of beverage vessels by the vessel top holding belt provided on the way of the main carrying conveyor path.

BRIEF DESCRIPTION OF THE DRAWINGS

The present invention is illustrated in detail by the accompanying drawings whereof.

DETAILED DESCRIPTION OF THE PREFERRED EMBODIMENT

The following describes in detail the straw adhering apparatus for beverage vessels in accordance with the present invention, referring to the accompanying drawings.

Figure 1:
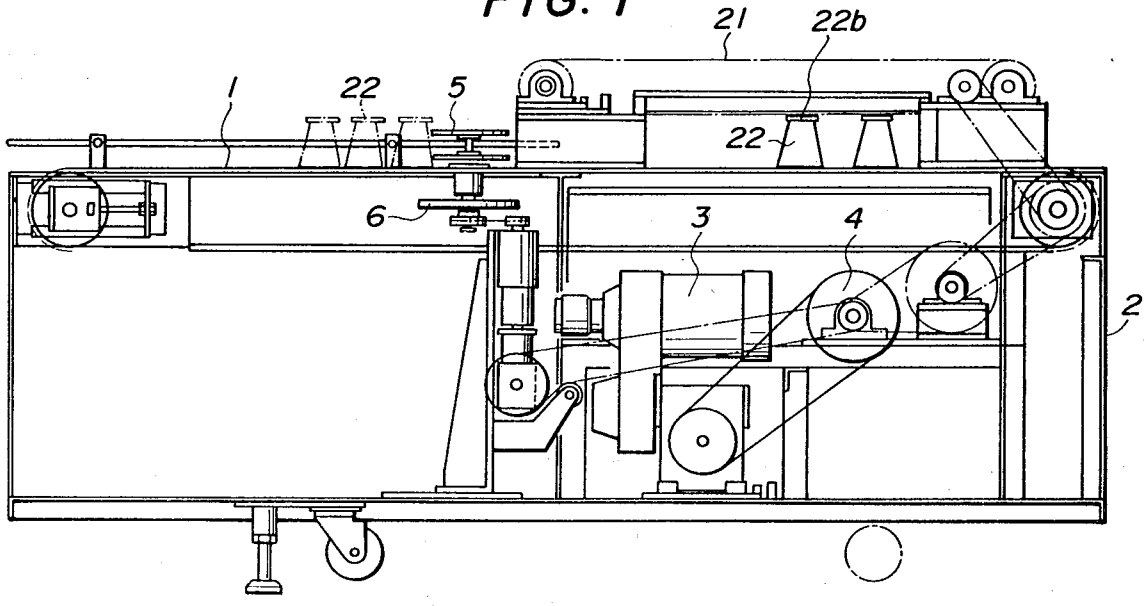
FIG. 1 is a front view of the apparatus in accordance with the present invention.
Figure 2:
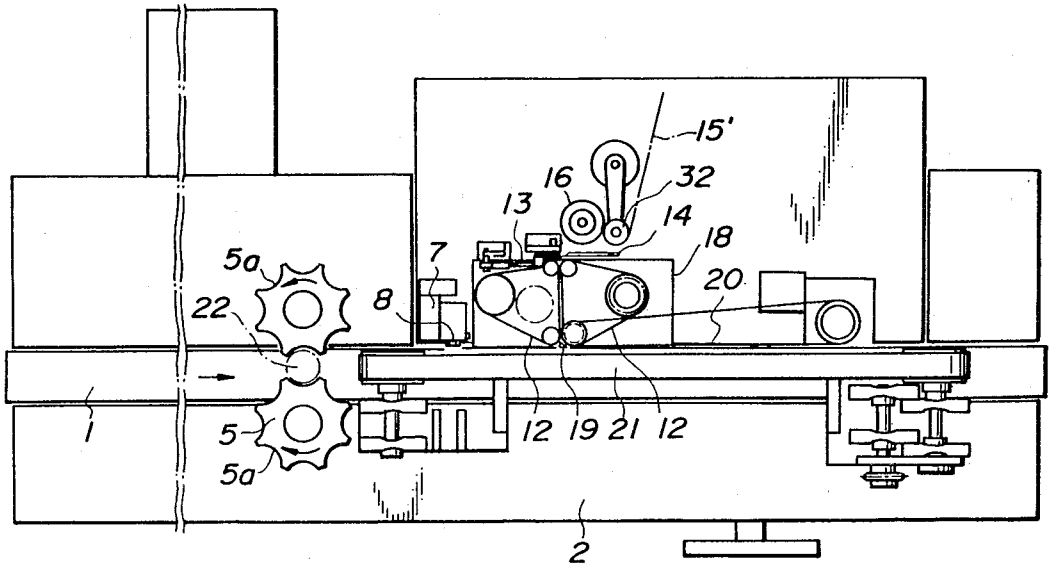
FIG. 2 is a plan view of the apparatus.
Figure 3:
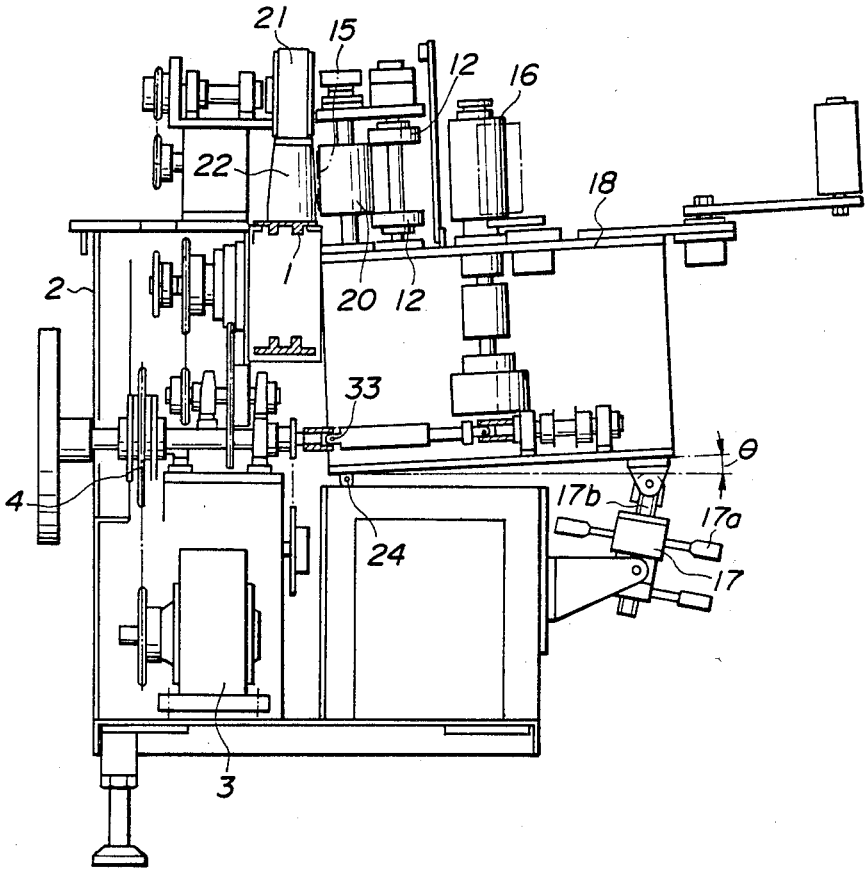
FIG. 3 is a side view showing the principal part of the apparatus.

The whole construction of the straw adhering apparatus for beverage vessels is shown in FIGS. 1 and 2. The main carrying conveyor 1 for conveying beverage vessels is rotated by the motor 3 provided at the center in the longitudinal direction of the apparatus body 2 through the appropriate transmission mechanism 4, and the separating turret 5 consisting of a pair of clutch type feed gears is provided at both halfway sides of said main carrying conveyor 1. Said separating turret 5 is provided to be rotated once by the rotating means 6 separated from said transmission mechanism 4. The adhesive agent applying device 7 supplies the hot melt type adhesive agent a from the nozzle 8 provided at the side of the main carrying conveyor 1 located ahead of the separating turret 5. Said adhesive agent applying device comprises a pair of straw pack delivering devices 13 consisting of rolls 11 opposingly provided above and below three support shafts 10 arranged in three positions and the seizing feed belts 12 which are engaged with said rolls 11 and provided at the side of the main carrying conveyor 1 located ahead of said adhesive agent applying device 7, and the cutter 14, which intermittently operates, outside on the line of the seizing feed belts **12*a* of said straw pack delivering device 13 and the sprocket type straw feed rollers 16 which pull the continuous straw-contained strip 15' with punched feed holes further outside the line of said seizing feed belts 12*a*. These straw feed rollers 16, cutter 14 and straw pack delivering device 13 are mounted on the support frame 18 which can be freely tilted by the angle adjust screw mechanism 17 provided on the outside of the apparatus body 2. The guide plate 19 is vertically provided at the outlet part 13***a* of a pair of seizing feed belts 12 of the straw pack delivering device 13 at the main carrying conveyor side and serves to change the direction of a single straw pack 15 which is vertically delivered to a horizontal direction to be parallel with the main carrying conveyor 1. The adhesion retaining belt 20 is provided at the side of the main carrying conveyor 1 located ahead of said guide plate 19. The vessel top holding belt 21 is provided above the main carrying conveyor 1 to be parallel with the whole area of the front position of said separating turrets. The photoelectric position detecting sensor 25 provided in the adhesive agent applying device 7 detects the beverage vessel 22 when it comes to the position of said adhesive agent applying device 7 to cause the adhesive agent a, shown in FIG. 8, to be sprayed from the nozzle 8 onto the external surface 22*a* of the beverage vessel 22. The detection sensor 31 detects the presence of a straw pack 15 arranged in the straw pack delivering device 13. The tension roller 32 is provided in the front stage of the straw feed roller 16 and the universal joint 33 of the transmission mechanism permits follow-up movement to the inclination provided below the support frame 18.

Figure 8:
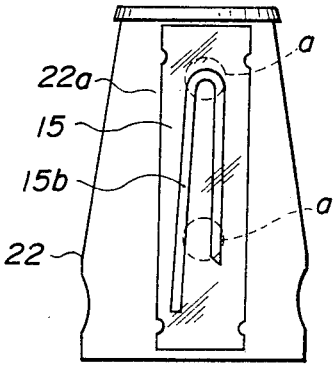
FIG. 8 is a front view of a beverage vessel to which a straw pack is adhered.

The following describes this follow-up movement. When the beverage vessel 22 is to be supplied onto the main carrying conveyor 1, the support frame 18 on which the straw pack delivering devices 13 are mounted is appropriately tilted in advance in accordance with the shape of the external surface 22*a* of the beverage vessel 22 so that a single straw pack which is delivered in a horizontal position is to be parallel with said external surface 22*a*. For example, in case the beverage vessel 22 is of a truncated shape as shown in FIG. 8, the support frame 18 is tilted around the pivotal part 24 at its one end by rotating the handle 17*a* of the angle adjust screw mechanism 17 located below the support frame 18 to deliver the screw shaft 17*b*, and therefore the straw feed rollers 16, cutter part 14, straw pack delivering device 13, and adhesion retaining belt 20, which are mounted on the support frame 18, are tilted altogether to a certain specified angle $\theta$ so that the straw pack 15 supplied from said straw pack delivering device 13 comes in contact with the external surface of the beverage vessel 22.

Hereupon, a group of beverage vessels 22 is supplied onto the main carrying conveyor 1 and a certain number of beverage vessels 22 are kept staying at the separating turret 5. A pair of gears forming the separating turret 5 rotate to cause only a single beverage vessel 22 to be held by feed grooves 5*a* and then forwarded. In other words, a beverage vessel 22 advances, keeping a certain distance kept by the separation turret 5 from the following group of beverage vessels 22.

The beverage vessel 22 which has passed through this separating turret 5 is held at its upper surface 22*b* by the vessel top holding belt 21 and by the main carrying conveyor 1 below the beverage vessel 22 and moved forward under stable condition. When said beverage vessel 22 comes to the position of the adhesive agent applying device 7, the photoelectric position detecting sensor 25 functions and a certain specified amount of adhesive agent a is sprayed from the nozzle 8 of the known hot melt type adhesive agent applying device 7 provided at the side and applied onto the external surface 22*a* of the beverage vessel 22.

Then when the beverage vessel 22 comes to the position of the straw pack delivering device 13, the photoelectric position detecting sensor 26 detects the beverage vessel 22, separated individual straw pack 15 is delivered in a horizontal position (in parallel with the main carrying conveyor 1 path) through the guide plate 19 and the lateral side 15*a* of said straw pack 15 is made to adhere to the part of adhesive agent a of said beverage vessel 22.

Figure 4:
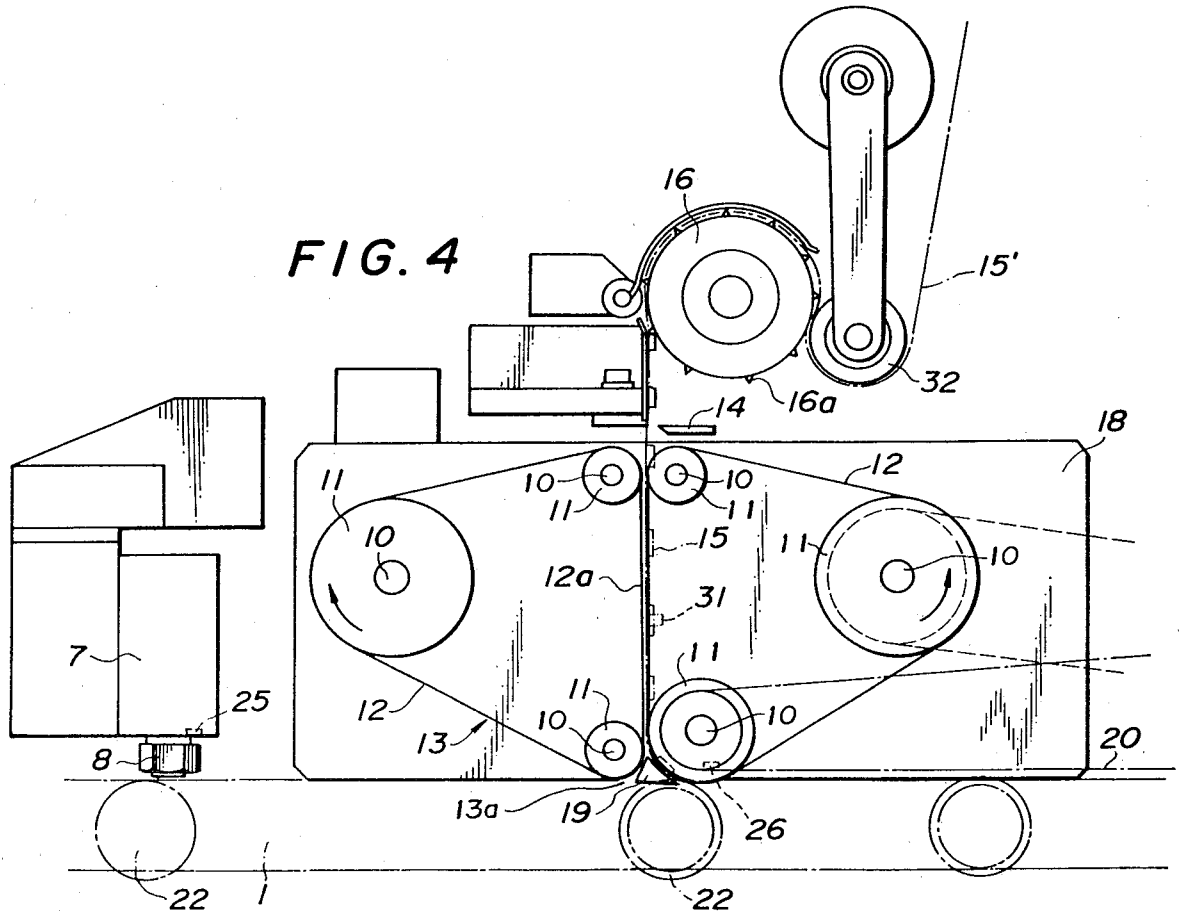
FIG. 4 is a plan view of the straw pack delivering device.
Figure 5:
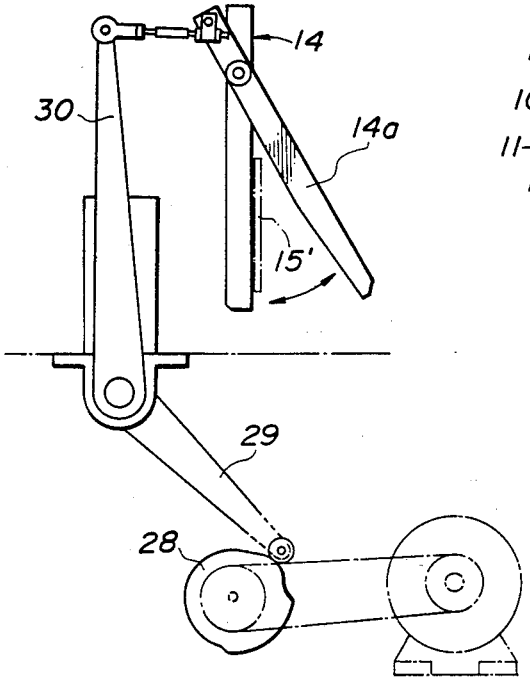
FIG. 5 is a side view of the cutter device.
Figure 6:
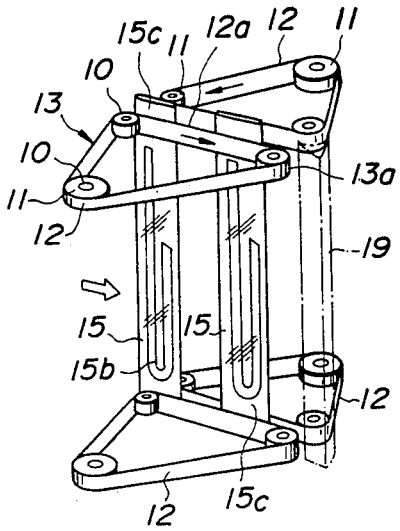
FIG. 6 is a perspective view of straw packs being delivered.
Figure 7:
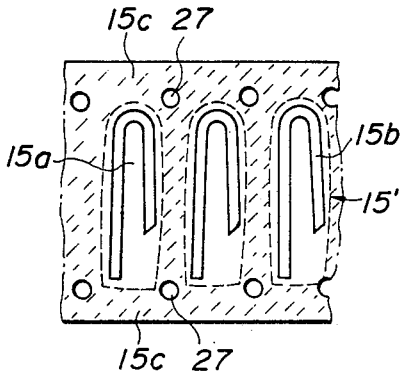
FIG. 7 is a front view of the continuous straw-contained strip provided with punched feed holes.

In this case, the continuous straw-contained strip wound in the shape of a roll (not shown) with punched feed rolls which is previously arranged is guided to the cutter body 14 side at fixed feed distances by the claws 16*a* (FIG. 4) of the sprocket type straw feed rollers 16 which rotate in accordance with the speed of the main carrying conveyor 1, said claws 16*a* being engaged with said punched feed holes of the strip, and the cutter part 14*a* (FIG. 4) of said cutter body 14 is actuated by the fulcrum lever 29 which follows up the cutter cam 28 and the operating lever 30 to cut the continuous straw-contained strip 15' which has been delivered to said specified distance (width of each straw pack containing one straw) to obtain separately cut straw packs 15. This separately cut single straw pack 15 is held at its upper and lower end parts 15*c* by opposed seizing feed belts 12 which form the straw pack delivering device 13 and moved to the main carrying conveyor 1 side while being kept in vertical position, and the straw pack 15 is automatically supplied in a horizontal position while being controlled by the tilted guide plate 19 arranged at the outlet of said straw pack delivering device 13.

Subsequently, the straw pack 15 adhered to the external surface 22*a* of the beverage vessel 22 is held at its rear side by the adhesion retaining belt 20 provided at the side of the main carrying conveyor 1 during movement along a certain specified distance and discharged outside the apparatus after the adhesive agent a has been dried.

As described above, the present invention provides the straw adhering apparatus comprising the separating turret which maintains a specified distance between beverage vessels on the main carrying conveyor, hot melt device, straw pack delivering device, and adhesion retaining belt which feeds a single straw pack in a vertical position and discharges it in a horizontal position when it is to be supplied, and vessel top holding belt; thus it is ensured that the beverage vessel (workpiece) is positively supplied in a stable condition to the hot melt applying position, and an individual straw pack which is cut into one piece at its lateral side after application of the adhesive agent is swung in the horizontal direction while being kept in the vertical position and is discharged after the adhesive agent has been dried. In other words, the continuous straw-contained strip is provided with punched feed holes to eliminate faulty movement during feeding, a single straw pack after having been cut is moved while being held at its upper and lower end parts, the cut straw pack is swung in the horizontal direction by utilizing the difference in frictional coefficients of the guide plate and the belt to perform transfer and adhesion of said cut straw pack so that the straw pack is positively adhered to the moving beverage vessel. Moreover, this straw pack delivering device permits adhesion of the straw pack in accordance with the shape of the beverage vessel since the support frame is made freely tiltable. Needless to say, the adhesion is ensured by the straw retaining belt which works until the adhesion agent (glue) is dried after adhesion.

In the accompanying drawings, a flexible straw which is bent in a U shape is shown as the packed straw. This U-shaped straw can be stretched into a straight form to facilitate sucking because it will be longer than the depth of the beverage vessel and therefore it is widely used for this purpose. The present invention can apply not only to a U-shaped straw but to conventional straight straws.

What is claimed is:

1. An apparatus for adhering a straw to a beverage vessel, comprising:

a main conveyor for carrying a plurality of beverage vessels along a predetermined path;

turret means, provided along the predetermined path of the main conveyor, for separating each of the plurality of beverage vessels from one another;

means, positioned downstream of the turret means along the predetermined path of the main conveyor, for applying an adhesive to a side of each of the plurality of beverage vessels being carried on the main conveyor;

means, arranged adjacent to but spaced from the main conveyor, for delivering a continuous strip containing a plurality to straws toward the plurality of beverage vessels being carried on the main conveyor, said delivering means being provided with a plurality of intermittent sprockets;

said continuous strip being provided with a plurality of holes spaced for engagement with the intermittent sprockets of the delivering means;

means, positioned between the main conveyor and the delivering means, for cutting the continuous strip through the plurality of holes into a plurality of individual straw packs;

first belt means, arranged between the main conveyor and the cutting means, for vertically feeding each of the plurality of individual straw packs in a straight line perpendicular to the side of each of the plurality of beverage vessels on the predetermined path of the main conveyor; and second belt means, arranged parallel to the predetermined path of the main conveyor, for retaining the plurality of individual straw packs in contact with the adhesive applied to the sides of the plurality of beverage vessels being carried on the main conveyor.

2. The apparatus according to claim 1, further comprising:

frame means, freely tiltable at an angle to the main conveyor, for supporting the first belt means and the second belt means thereon.

3. The apparatus, according to claim 2, further comprising:

plate means, positioned on the frame means at a point of convergence between the first belt means and the second belt means with the main conveyor, for guiding the plurality of individual straw packs into contact with the adhesive applied to the sides of the plurality of beverage vessels being carried on the main conveyor.

* * * * *